US006820872B2

(12) United States Patent
Ko et al.

(10) Patent No.: US 6,820,872 B2
(45) Date of Patent: Nov. 23, 2004

(54) MEDIA CASSETTE AND MEDIA DISPENSING MACHINE HAVING THE SAME

(75) Inventors: Kyung-Ho Ko, Pyeongtaek (KR); Jae-Wook Ahn, Cheonan (KR)

(73) Assignee: LG N-Sys Inc., Seoul (KR)

( * ) Notice: Subject to any disclaimer, the term of this patent is extended or adjusted under 35 U.S.C. 154(b) by 0 days.

(21) Appl. No.: 10/238,856

(22) Filed: Sep. 11, 2002

(65) Prior Publication Data

US 2003/0047568 A1 Mar. 13, 2003

(30) Foreign Application Priority Data

Sep. 12, 2001 (KR) ..... 2001-56216
Dec. 27, 2001 (KR) ..... 2001-86122

(51) Int. Cl.[7] ..... B65H 1/00
(52) U.S. Cl. ..... 271/162; 271/164; 221/287
(58) Field of Search ..... 271/145, 162, 271/164; 221/197, 287; 109/45, 47, 50, 51

(56) References Cited

U.S. PATENT DOCUMENTS 4,603,847 A * 8/1986 Oota et al. ..... 271/10.07
5,100,022 A * 3/1992 Fukudome et al. ..... 221/198
6,014,594 A * 1/2000 Heidel et al. ..... 700/231
6,289,261 B1 * 9/2001 Heidel et al. ..... 700/231

* cited by examiner

*Primary Examiner*—David H. Bollinger
(74) *Attorney, Agent, or Firm*—Birch, Stewart, Kolasch & Birch, LLP

(57) ABSTRACT

A media dispensing machine having a media cassette which includes a casing disposed in a media cassette receiving unit of the media dispensing machine; a media loading unit disposed in the casing and storing media; a driving unit installed at a certain side of the media loading unit inside the casing and operated by a power transmitting unit of the media dispensing machine for dispensing the media stored in the media loading unit; a media guiding unit installed so as to connect the driving unit with an outlet formed at the outer surface of the casing and guiding the media dispensed by the driving unit to a media conveying unit of the media dispensing machine; and a media dispense security unit for controlling the driving unit so as to operate only when the casing is installed in the media cassette receiving unit of the media dispensing machine.

18 Claims, 11 Drawing Sheets

MEDIA CASSETTE AND MEDIA DISPENSING MACHINE HAVING THE SAME

BACKGROUND OF THE INVENTION

1. Field of the Invention

The present invention relates to a media dispensing machine, and in particular to a media cassette and a media dispensing machine containing the same.

2. Description of the Prior Art

In general, an automated teller machine (ATM) is installed at a location such as a bank, a convenience store and a subway station, etc. where many people pass, and a user can withdraw money from his/her bank account through the ATM with a simple operation.

The ATM includes a media cassette for storing media and a media conveying unit for conveying the media from the media cassette to a media dispensing unit, when the user inputs a withdrawal of an expected amount of money through a button operation, whereby the media stored in the media cassette are supplied to the media dispensing unit through the media conveying unit.

FIG. 1 is a sectional view illustrating the construction of a media cassette of a media dispensing machine in accordance with the prior art.

FIG. 2 is a partial sectional view illustrating part of the media cassette in FIG. 1.

As depicted in FIGS. 1 and 2, the media cassette 1 of the media dispensing machine in accordance with the conventional art includes a casing 10 having an internal space in which media (B) are loaded; a door 20 for covering the casing 10; and a dispensing means installed at a side of the casing 10 and connected to a power generating means (not shown) disposed in the media dispensing machine, for receiving the driving force of the power generating means and for dispensing the media (B) loaded in the casing 10.

The dispensing means includes a driving shaft 30 rotatably combined with both sides of the casing 10; a rotational gear 40 combined with the driving shaft 30 for receiving power generated by the power generating means through a power transmitting unit (S1) and for rotating the driving shaft 30; a pair of sub shafts 50 rotatably combined in parallel with the driving shaft 30; a gear train (G) engaged with the driving shaft 30 and the sub shafts 50 for transmitting the rotational force of the driving shaft 30 to the sub shafts 50; and conveying rollers (R) fixedly combined with the sub-shafts 50 for conveying the media loaded in the casing 10 to the media dispensing unit through a dispensing hole 11 formed at a certain side of the casing 10 according to the rotation of the sub shafts 50.

FIG. 3 is a diagram illustrating the media cassette in FIG. 1 mounted in the media dispensing machine.

In the media cassette of the media dispensing machine in accordance with conventional art, media are loaded in the casing 10, the door 20 combined with the side of the casing 10 is closed, the door is locked by a locking device (not shown), and the media cassette 1 is mounted onto a media cassette receiving unit (S) of the media dispensing machine as depicted in FIG. 3.

Herein, the power transmitting unit (S1) is installed at the media cassette receiving unit (S), and accordingly the rotational gear 40 constructing the dispensing means is connected to the power transmitting unit (S1).

In this state, the driving force is transmitted by the power transmitting unit (S1) according to an inputted signal, the driving force is transmitted to the driving shaft 30 through the rotational gear 40, and accordingly the driving shaft 30 is rotated.

When the driving shaft 30 is rotated, the rotational force of the driving shaft 30 is transmitted to the sub shafts 50 through the gear train (G), and the conveying rollers (R) combined with the sub shafts 50 are rotated with the rotation of the sub shafts 50.

With the rotation of the conveying rollers (R), the media (B) loaded in the casing 10 are conveyed to the media conveying unit through the dispensing hole 11 by being tightly contacted with the conveying rollers (R), and the media (B) conveyed to the media conveying unit are supplied to the media dispensing unit. The user can withdraw the media (B) supplied to the media dispensing unit.

However, in the conventional media cassette of the media dispensing machine, it is possible to remove the media (B) loaded in the casing 10 without opening the door 20, and accordingly the media (B) may accidentally flow out.

In more detail, when the conveying rollers (R) are rotated manually, the media (B) loaded in the casing 10 can be easily removed through the dispensing hole 11 creating the possibility of theft.

SUMMARY OF THE INVENTION

In order to solve the above-mentioned problem, it is an object of the present invention to provide a media cassette and a media dispensing machine capable of preventing media which is loaded in a casing of the media cassette from being removed without passing through a door.

In order to achieve the above-mentioned object, a media cassette of a media dispensing machine in accordance with the present invention includes a casing disposed in a media cassette receiving unit of a media dispensing machine; a media loading unit disposed in the casing and storing media; a driving unit installed at a certain side of the media loading unit inside the casing, operated by a power transmitting unit of the media dispensing machine for dispensing the media stored in the media loading unit; a media guiding unit installed so as to connect the driving unit with an outlet formed at the outer surface of the casing for guiding the media dispensed by the driving unit to a media conveying unit of the media dispensing machine; and a media dispense security unit for controlling the driving unit so as to operate only when the casing is installed in the media cassette receiving unit of the media dispensing machine.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
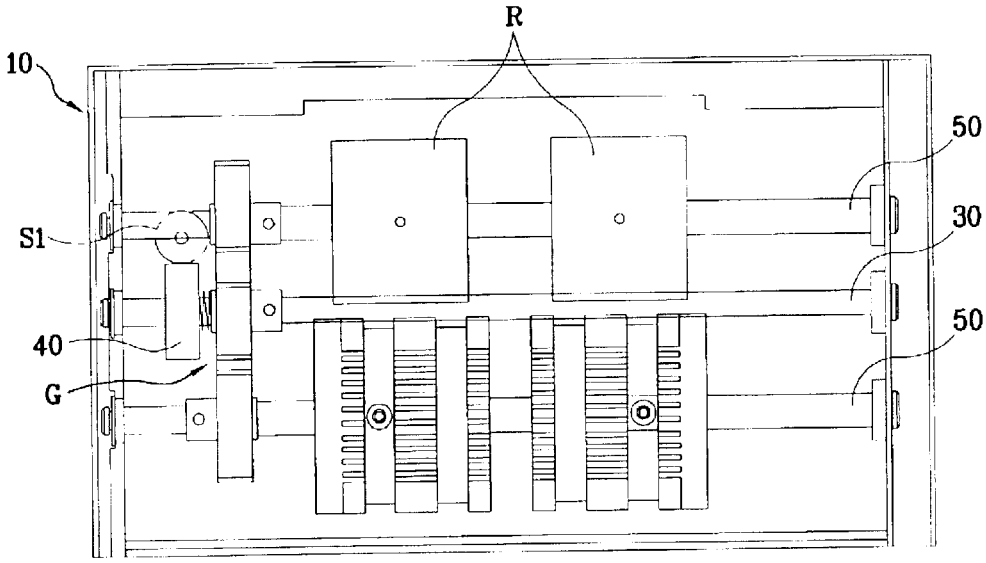
FIG. 1 PRIOR ART
FIG. 1 is a sectional view illustrating a construction of a media cassette of a media dispensing machine in accordance with the conventional art.
Figure 2:
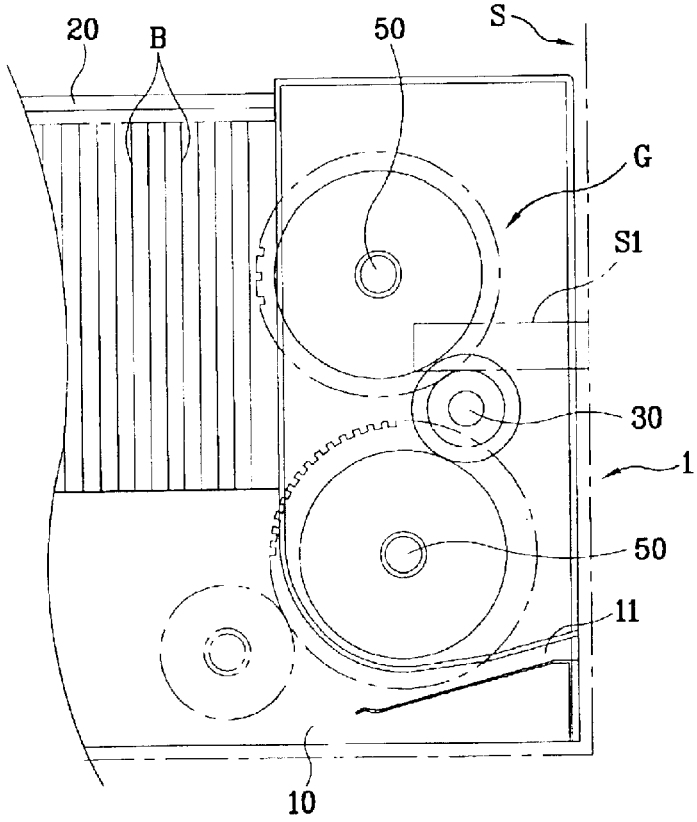
FIG. 2 PRIOR ART
FIG. 2 is a partial sectional view illustrating part of the media cassette in FIG. 1.
Figure 3:
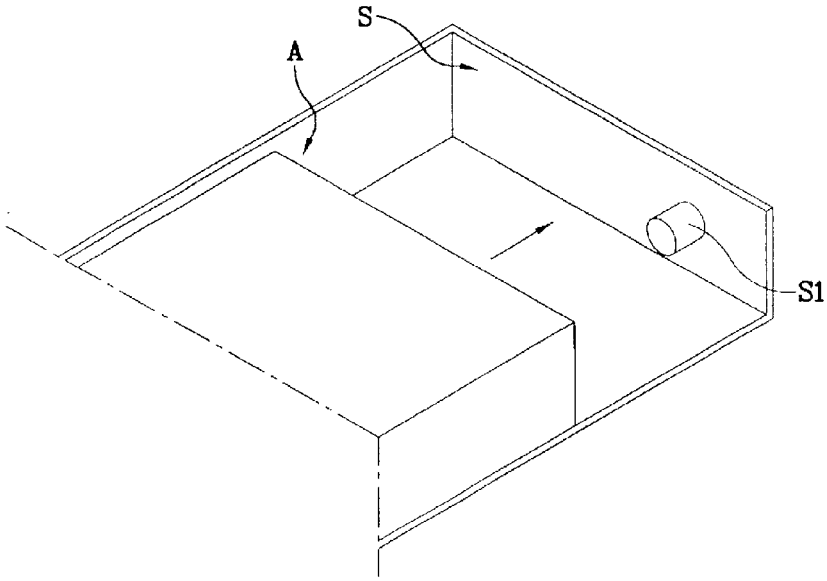
FIG. 3 PRIOR ART
FIG. 3 is a diagram illustrating the media cassette in FIG. 1 mounted onto the media dispensing machine.
Figure 4:
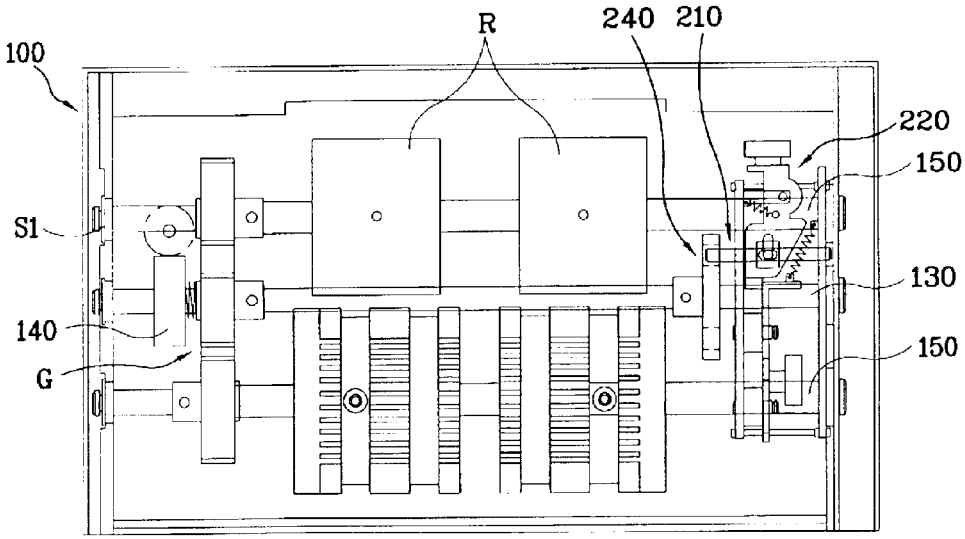
FIG. 4 is a sectional view illustrating the construction of a media dispensing machine in accordance with the present invention.
Figure 5:
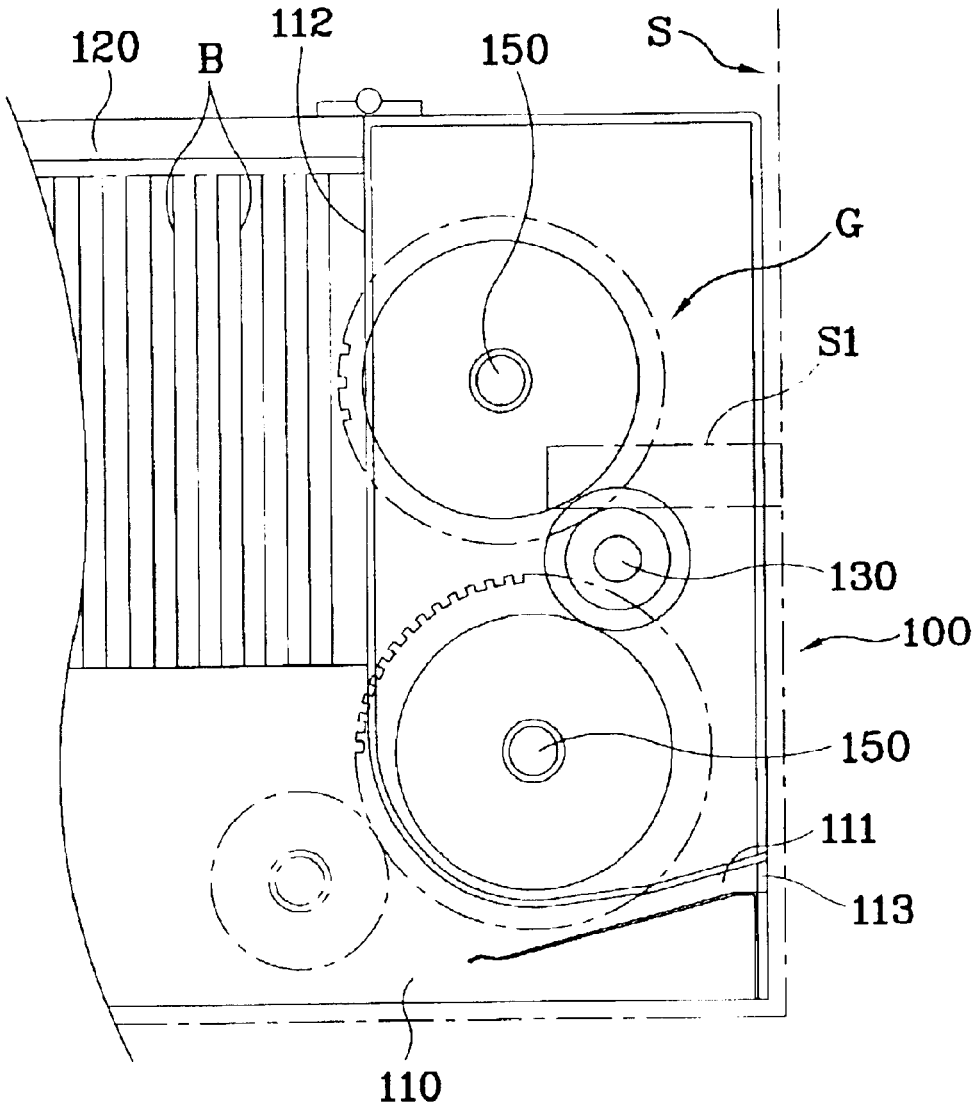
FIG. 5 is a partial sectional view illustrating part of the media cassette of FIG. 4.
Figure 6:
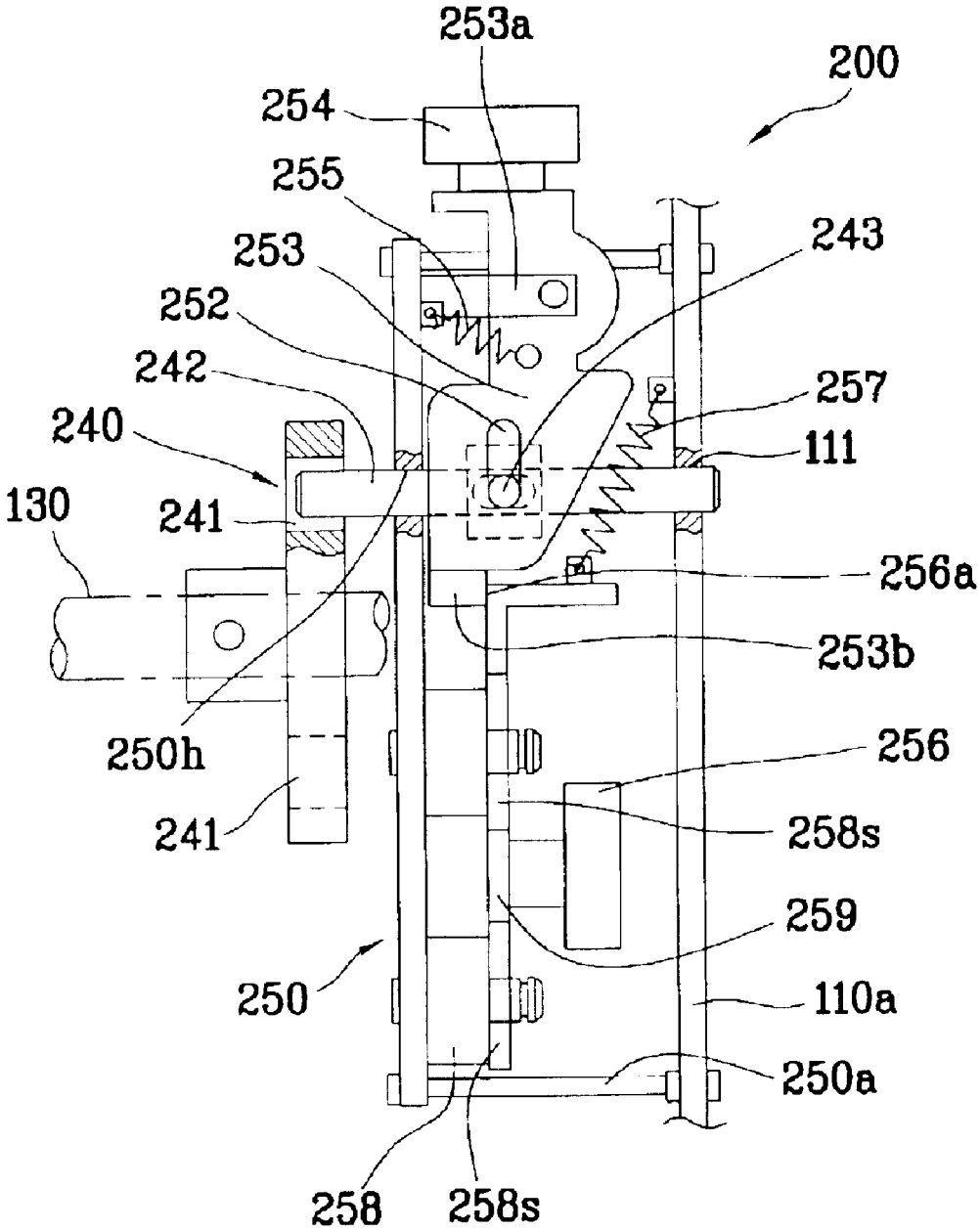
FIG. 6 is a partial sectional view illustrating a media dispense security unit of the media cassette in FIG. 4.
Figure 7:
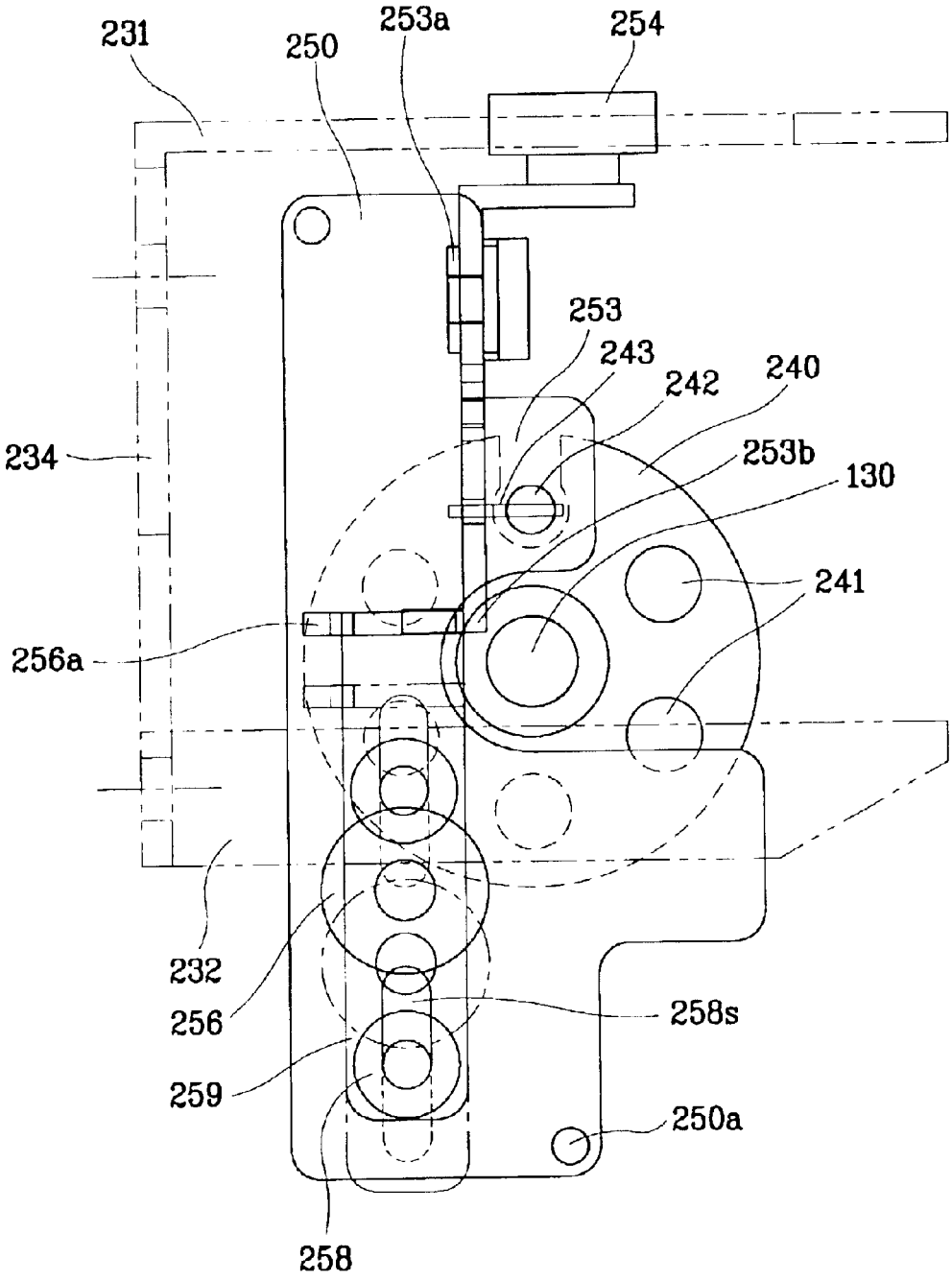
FIG. 7 is a diagram illustrating the control key and a part of the media dispense security unit in FIG. 4.
Figure 8:
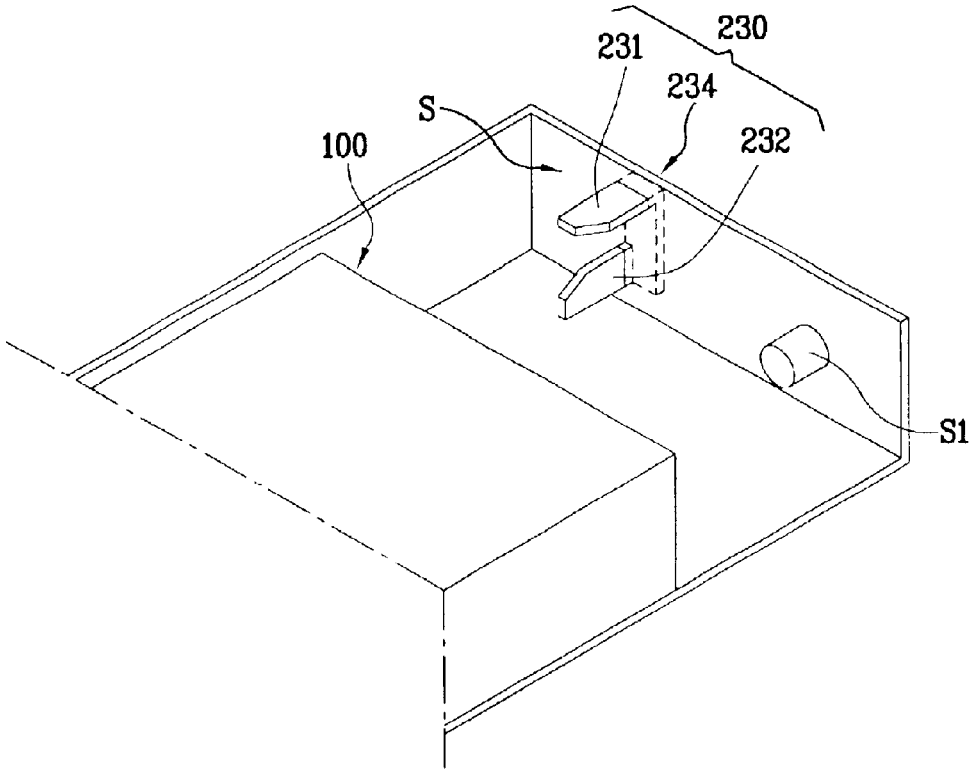
FIG. 8 is a conceptual view illustrating the media cassette of FIG. 4 mounted onto the media dispensing machine.
Figure 9:
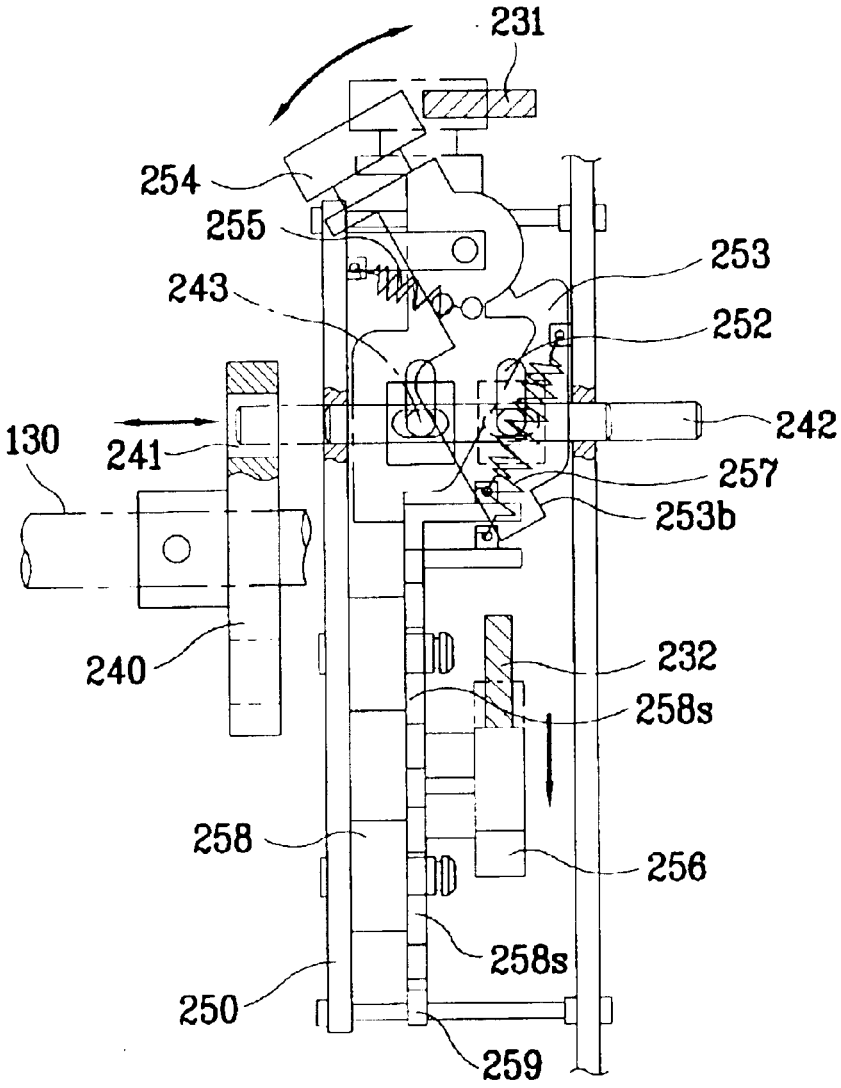
FIG. 9 is a conceptual view illustrating the operation of the media dispense security unit of the media cassette of FIG. 4.

Hereinafter, a media cassette and a media dispensing machine containing the same in accordance with the present invention will be described in detail with reference to accompanying drawings.

As depicted in FIGS. 4–9, a media cassette 100 in accordance with the present invention includes a casing 110 disposed in a media cassette receiving unit (S) of the media dispensing machine; a media loading unit 112 disposed in the casing 110 and storing media (B); a driving unit 160 installed at a side of the media loading unit 112 inside the casing 110, and operated by a power transmitting unit (S1) of the media dispensing machine and dispensing the media (B) stored in the media loading unit 112; a media guiding unit 111 connecting the driving unit 160 with an outlet 113 formed at the exterior of the casing 110 for guiding the media (B) dispensed by the driving unit 160 to a media conveying unit (not shown) of the media dispensing machine through the outlet 113; and a media dispense security unit 200 for controlling the driving unit 160 to operate only when the casing 110 is installed onto the media cassette receiving unit (S) of the media dispensing machine.

The media loading unit 112 has an appropriate loading space for loading media (B), herein, and the media (B) can be taken out, one by one, by the operation of the driving unit 160.

The door 120 is rotatably combined with the upper portion of the media loading unit 112 by hinges in order to cover it. And, a plurality of openings (not shown) for taking out media (B) are formed at a portion at which the media loading unit 112 contacts with the driving unit 160.

The driving unit 160 includes a driving shaft 130 rotatably installed at the side of the media loading unit 112; a rotational gear 140 for receiving power from the power transmitting unit (S1), combined with the driving unit 130 and rotating the driving shaft 13; and a plurality of sub shafts 150 rotatably installed at the casing 110 so as to be near to the driving shaft 130.

Gear train (G) is combined with the driving shaft 130 and the sub shafts 150 in order to transmit the driving force from the driving shaft 130 to the sub shafts 150.

Conveying rollers (R) are respectively combined with the sub shafts 150 conveying the media loaded in the casing 110 to the media conveying unit through the outlet 113 formed at the side of the casing 110 after passing the media guiding unit 111 according to the rotation of the sub shafts 150. One of the sub shafts 150 contacts to the media (B) through the opening of the media loading unit 112 and conveys the media (B) one by one in the operation.

The media dispense security unit 200 includes an operation restraint unit 210 for restraining the operation of the driving unit 160 by preventing the driving shaft 130 of the driving unit 160 from rotating; and a control key coupling 220 for releasing the operation restraint unit 210 to make the driving unit 160 operate when a control key 230 installed at the media cassette receiving unit (S) is inserted.

The control key 230 includes a first control key 231 curved-extended from the end of a fixing portion 234 having a certain area and length vertical to the surface of the fixing portion 234 and having a slant at the end; and a second control key 232 curved-extended from the other end of the fixing portion 234 and having a slant at the end.

The control key 230 is fixedly combined with the media conveying unit to make the first control key 231 and the second control key 232 project from the media cassette receiving unit (S) at which the media cassette 100 is mounted thereto.

The operation restraint unit 210 includes a rotation restraint plate 240 fixedly inserted into the driving shaft 130 of the driving unit 160 and having a plurality of insertion holes 241 making a circle centering around the driving shaft 130; and a fixing pin 242 pin-combined with the control key coupling 220 and inserted/released into/from the insertion hole 241 by the control key coupling 220.

The end of the fixing pin 242 is inserted/released into/from the insertion hole 241 formed at the rotation restraint plate 240, and a sub pin 243 is formed vertical to the fixing pin 242.

The control key coupling 220 includes a fixing plate 250 installed at the internal wall of the casing 110 vertical to the driving shaft 130 of the driving unit 160; a fixing pin connecting portion 253 having a slot 252 in which the sub pin 243 connected to the fixing plate 250 and fixedly installed at the fixing pin 242 is inserted; a first releasing portion 254 for linearly moving the fixing pin 242 to release the fixing pin 242 from the insertion hole 241 by moving the fixing pin connecting portion 253 with the first control key 231 when the media cassette 100 is mounted onto the media cassette receiving unit (S); a first elastic member 255 for returning the fixing pin connecting portion 253 to the initial position; a second releasing unit 256 for releasing the fixing pin connecting portion 253 by the operation of the second control key 232 while fixing the fixing pin connecting portion 253; and a second elastic member 257 for returning the second release portion 256 to the initial position.

The fixing plate 250 is fixedly installed at the internal wall of the casing 100 by a fixing member 250*a* with a certain distance from the internal wall of the casing 250 so as to make the driving shaft 130 and the sub shafts 130 rotate A through hole 250*h* is formed at the fixing plate 250 to make the fixing pin 242 move linearly. In particular, in order to make the fixing pin 242 perform the linear motion smoothly, a hole 111 can be formed at the internal wall 110*a* of the casing 110.

The fixing pin connecting portion 253 is rotatably hinge-combined with a supporting portion 253*a* installed at the fixing plate 250, the fixing pin 242 is linearly moved while the first releasing portion 254 is moved by the first control key 231.

In addition, a projecting portion 253*b* is curved-extended from the lower portion of the fixing pin connecting portion 253.

A first releasing portion 254 is fixedly connected to the upper portion of the fixing pin connecting portion 253, and it is formed as a cylindrical body having a certain thickness and an outer diameter. The first releasing portion 254 is moved by contacting to the first control key 231 when the media cassette 100 is mounted onto the media cassette receiving unit (S).

The first elastic member 255, namely, a spring is installed between the fixing plate 250 and the fixing pin connecting portion 253 in order to return the first releasing portion 254 to the initial position when the contact to the first control key 231 is released.

The second releasing portion 256 fixes the fixing pin connecting portion 253 from rotating by maintaining the contact state with the protrusion portion 253*b* connected to the fixing pin connecting portion 253. It includes a contact portion 256*a* having a certain thickness and an outer diameter for releasing the contact state with the protrusion portion 253*b* by moving downwardly by contacting to the second control key 232; and a sliding member 259 having a slot 258*a* in which the contact portion 256*a* is fixedly installed and a least one guide member 258 (two in the present invention) is inserted.

The sliding member 259 contacts to a protrusion portion 253*b* until the media cassette 100 is mounted into the media cassette receiving unit (S), after the media cassette 100 is mounted into the media cassette receiving unit (S), the sliding member 259 performs the linear-motion downwardly along the guide member 258.

The sliding member 259 is connected to the elastic member fixing member 112 and the second elastic member 257 is installed at the internal wall 110*a* of the casing 110. When the contact portion 256*a* does not contact the second control key 232, the sliding member 250 returns to the initial position, and accordingly it maintains the contact state with the protrusion portion 256*a*.

In the meantime, the media cassette 100 of the media dispensing machine in accordance with the present invention can further include a state display unit 300 for displaying the operation state of the media dispense security unit 200 when the media cassette 100 is not mounted into the media cassette receiving unit (S).

As depicted in FIGS. 10–13, the state display unit 300 is installed at a space formed at the side surface of the driving unit 160 to operate with the media dispense security unit 200.

The state display unit 300 includes a first supporting member 310 fixedly installed at the internal surface 110*a* of the casing 110; a first link portion 320 disposed in the casing 110, supported by the first supporting member 310 in the contact state with the first releasing portion 254, performing a linear motion by the first releasing portion 254 and having a link pin 321 at the end; a second link portion 330 installed at the second supporting member 360 fixedly installed at the outside of the internal wall 110*a* of the casing 110 so as to perform vertically the linear motion in the motion direction of the first link portion 320, having an engaging portion 331 engaged with the link pin 321 and a pair of display surfaces 332; a third and a fourth elastic members 315, 333 for respectively returning the first and the second link portions 320, 330 to their initial positions; a display hole 340 formed at the casing 110 to show only one (332*a* or 332*b*) of the display surface 332 to the outside according to the moving of the second link portion 330; and a display key insertion hole 342 formed at the casing 110 to receive the display key 235 formed at the media cassette receiving unit (S) in order to fix the second link portion 30 when the media cassette 100 is mounted into the media cassette receiving unit (S).

Figure 10:
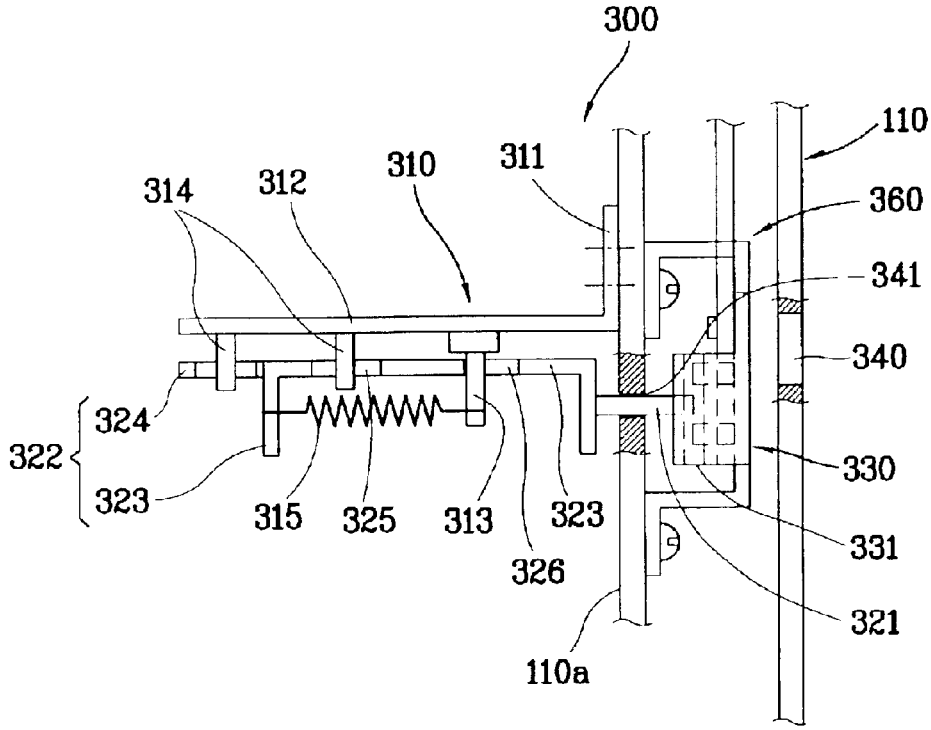
FIG. 10 is a sectional view illustrating the construction of a state display unit of the media cassette of FIG. 4.

As depicted in FIG. 10, the casing of the media cassette 100 at which the state display unit 300 is installed consists of two internal walls 110*a*, 110*b* installed at regular intervals.

The first supporting member 310 includes a link fixing portion 311 having a certain thickness and an area and fixedly installed at the internal wall 110*a* of the casing 120; an installation portion 312 curved-extended from the link fixing portion 311 so as to have a certain area; a spring fixing pin 313 fixedly combined with the side of the installation portion 312; and plural first guide pins 314. Herein, the installation portion 312 is vertical to the internal wall 110*a* of the casing 120.

The first link portion 320 includes a first sliding member 322 combined with the installation portion 312 so as to slide, and a link pin 321 is fixedly installed at the end of the first sliding member 322.

The first sliding member 322 includes a 'U'-shaped curved plate 323 having a certain width and a thickness; an extended portion 324 curved-extended from the curved plate 323 and having a first slot 324*h*; and a second and third slots 325, 326 respectively formed at the curved plate 323 at a certain intervals. The link pin 321 is fixedly installed at the outer surface of the curved plate 323.

In the first sliding member 322, the first and second slots 324*h*, 325 are respectively installed to the first guide pins 314 of the installation portion 312, and the third elastic member 315 is fixedly installed in the third slot 326. The first sliding member 322 is fixedly combined with the sliding member 323 in order to insert the link pin 321 into the through hole 341 formed at the internal wall 110*a* of the casing 110.

Both ends of the third elastic member 315 are respectively combined with the spring fixing pin 313 and the curved plate 323. Herein, the extended portion 324 of the first sliding member 322 has a certain interval with the first releasing portion 254 of the media cassette dispense security unit 200.

A certain-shaped second supporting member 360 is fixedly combined with the outside (the opposite surface) of the internal wall 110*a* of the casing 110. The second supporting member 360 has a section similar to a rectangle, and it includes a second spring fixing pin 361 and plural second guide pins 362.

A second link portion 330 having a certain shape combines with the second supporting member 360 so as to move linearly.

The second link portion 330 includes a plate 335 having a certain thickness and size; an engaging portion 331 curved-extended from the side of the plate 335; a plurality of guide holes 336 formed at the plate 335; and a link combining pin 334 placed inside the plate 335. The display surface 332 is formed at a certain side of the plate 335.

Figure 11:
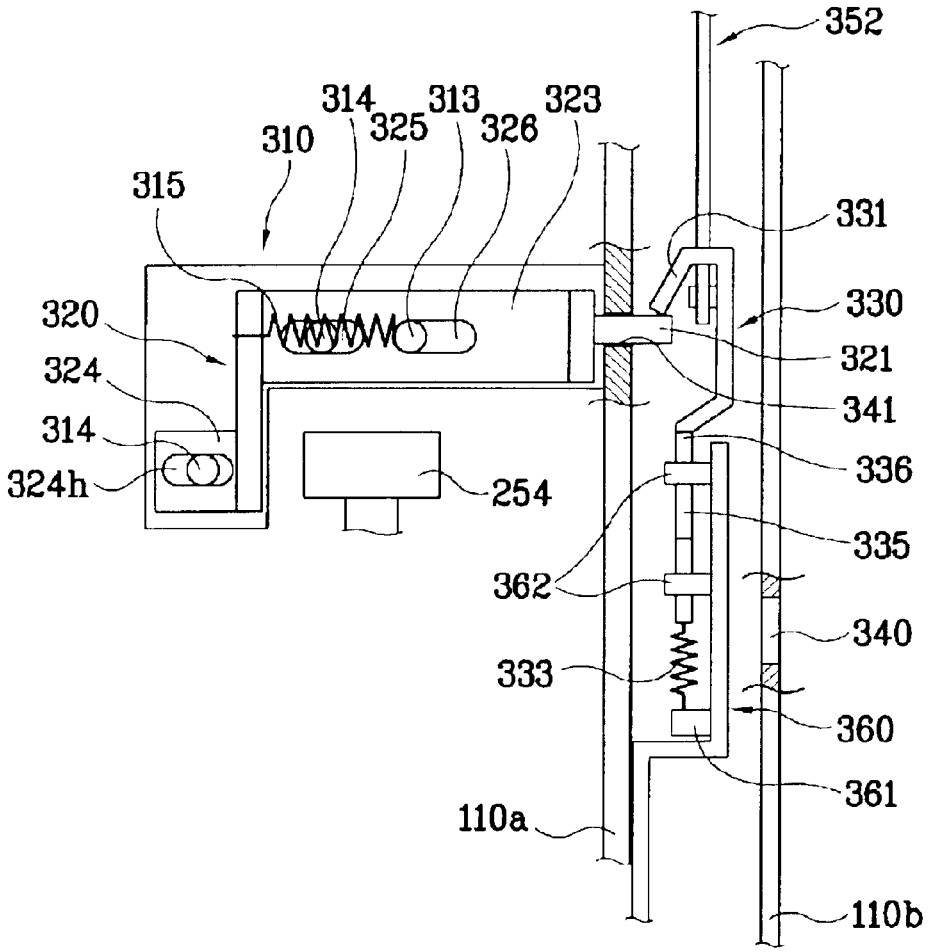
FIG. 11 is a side, sectional view illustrating the state display unit of FIG. 10.
Figure 12:
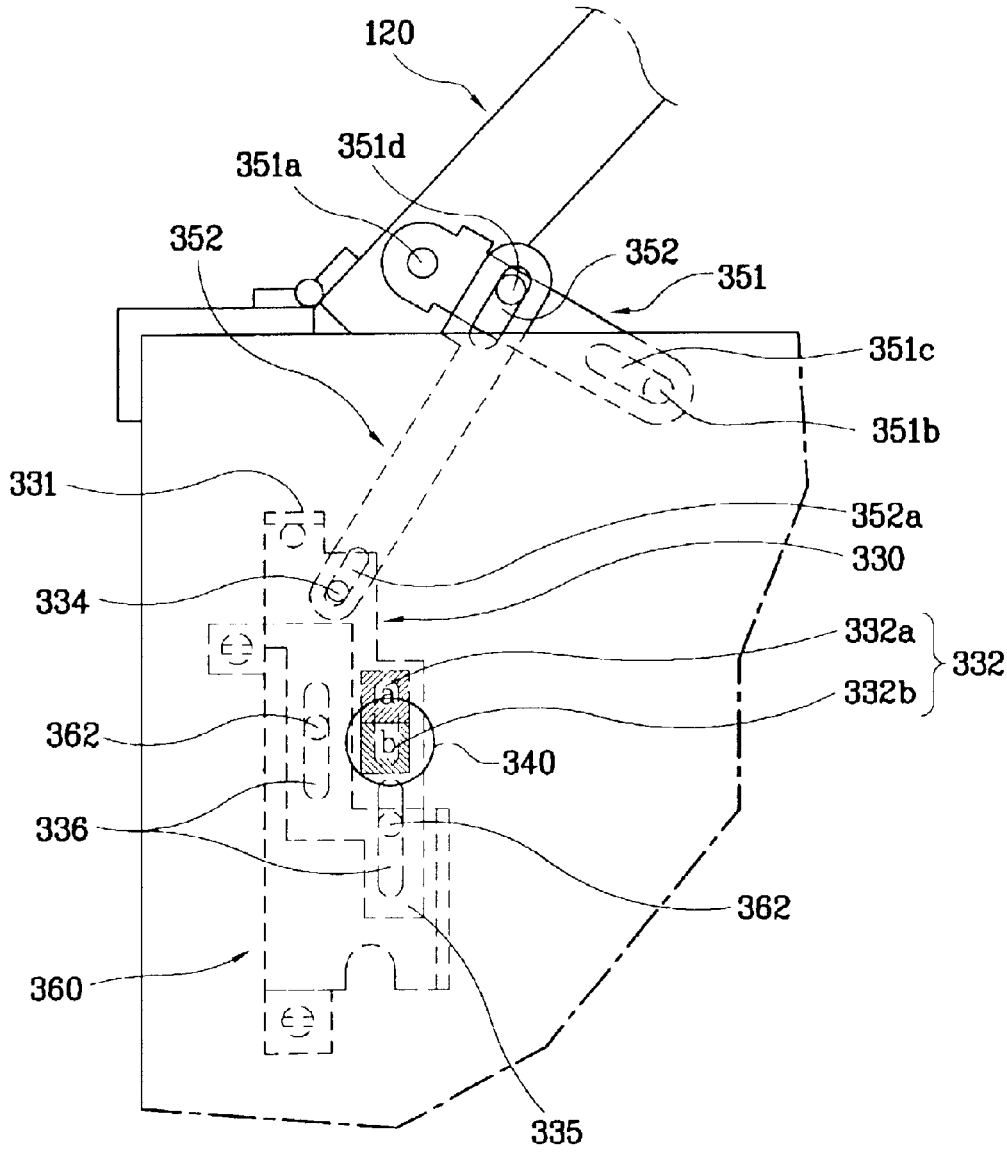
FIG. 12 is a perspective drawings illustrating the state display unit in FIG. 10 and part of a door from outside of a casing.
Figure 13:
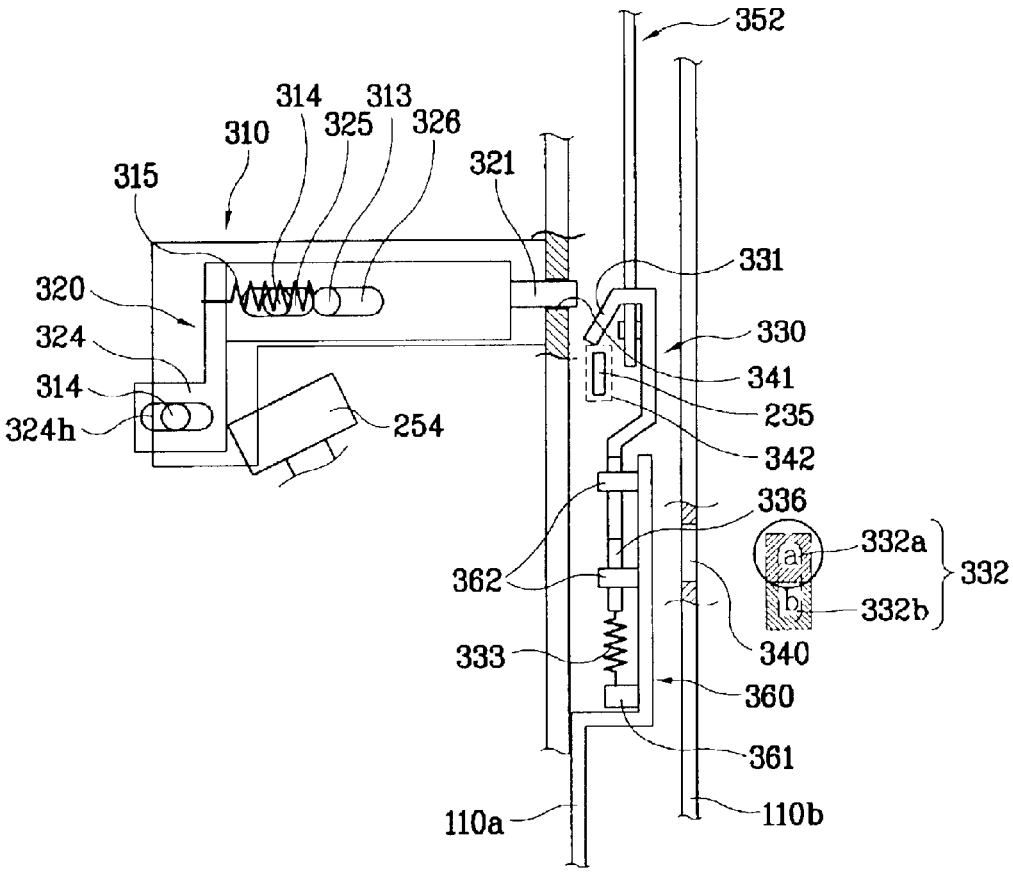
FIG. 13 is a conceptual view illustrating the operation of the state display unit of FIG. 10.

The display surface 332 consists of a pair of display surfaces moving in the length direction and having a color different from each other. It is preferable for the display surface 332 to display the red portion 332*a* and the green portion 332*b* upward and downward. As depicted in FIG. 11, it is preferable for the engaging portion 331 to have a slant.

The second link portion 330 is combined with the second supporting member 360 so as to insert the plural guide holes 336 into the second guide pin 362 respectively, and both ends of the fourth elastic member 334 are respectively fixed to the end of the second spring fixing pin 361 of the second supporting member 360 and the end of the plate 335 of the second link portion 330.

Herein, when the second link portion 330 is placed upwardly, the engaging portion 331 engages with the link pin 331 inserted into the plate through hole 341, and the green portion 332*b* of the display unit 332 is shown through the display hole 340 of the casing 110. And, the second link portion 330 is placed downwardly by the pulling force of the fourth elastic member 333, the engaging portion 331 is placed at the lower portion of the link pin 331, and the red portion 332*a* of the display unit 332 is shown through the display hole 340 of the casing 110.

A door link unit connects the second link portion 330 with the door 120 hinge-combined with the casing 110. The door link unit includes a first door link member 351 combined with the door 120 and the casing 10 and limiting an opening angle of the door 120; a link combining pin 334 and a combining pin 351*d* respectively combined with the side of the second link portion 330 and a certain portion of the first door link member 351; and a second door link member 352 having a certain length, having long holes 352*a*, 352*b* respectively formed at both ends. Herein, the long holes 352*a*, 352*b* are respectively combined with the link combining pin 334 of the second link portion 330 and the combining pin 351*d* of the first door link member 351.

In the first door link member 351, the end is hinge-combined with the door combining pin 351*a* installed at the internal surface of the door 120 placed on the side surface of the casing 110 on which the state display unit 300 is installed, and a slot 351*c* for receiving the side surface combining pin 351*b* installed at the side surface of the casing 120 on which the state display unit 300 is installed is formed.

Hereinafter, the operation of the media cassette in accordance with the present invention will be described with reference to accompanying drawings.

First, the media (B) are loaded in the media loading unit 112 of the media cassette 100, the door 120 combined with the side of the casing 110 is closed, and the door is locked by the locking device (not shown). Herein, the fixing pin connecting portion 253 is in parallel to the fixing plate 250 and the casing 110 by the pulling of the first elastic member 255, the fixing pin 242 combined with the fixing pin connecting portion 253 is inserted into the insertion hole 241 of the rotation restraint plate 240 combined with the driving shaft 130, the rotation of the driving shaft 130 is prevented, and accordingly the rotation of the conveying rollers (R) is restrained. In addition, by the pulling of the second elastic member 257, the sliding member 259 moves toward the fixing pin connecting portion 253, the side of the sliding member 259 is contacted-supported by the protrusion portion 253*b* of the fixing pin connecting portion 253, and accordingly the moving of the fixing pin connecting portion 253 is restrained.

When the media cassette 100 is not mounted onto the media dispensing machine, by preventing the rotation of the driving shaft 130 and the conveying rollers (R) geared with the driving shaft 130, the media (B) loaded in the media cassette 100, namely, inside the casing 110 can not be taken out without opening the door 120.

When the media cassette 100 is mounted onto the media dispensing machine, the rotational gear 140 combined with the driving shaft 130 of the media cassette 100 is connected to the power transmitting unit (S1). Simultaneously, the first control key 231 and the second control key 232 installed in the media cassette receiving unit (S), respectively, contact to push the second releasing portion 256 of the sliding member 259 and the first releasing portion 254 of the fixing pin connecting portion 253.

In more detail, when the media cassette 100 is installed, the control key 230 is inserted into the media cassette 100, the slant of the first control key 231 and the slant of the second control key 232 of the control key 230 push the first releasing portion 254 of the fixing pin connecting portion 253 and the second releasing portion 256 of the sliding member 259 sequentially.

By the second control key 232 of the control key 230, the sliding member 259 is pushed in the opposite direction of the fixing pin connecting portion 253 by being guided by the guide members 258. The contact state of the sliding member 259 and the fixing pin connecting portion 253 is released, and accordingly the sliding member 259 releases the restraint of the fixing pin connecting portion 253.

As described above, when the restraint of the fixing pin connecting portion 253 is released by the first control key 231 of the control key 230, the first releasing portion 254 of the fixing pin connecting portion 253 is pushed, and accordingly the fixing pin connecting portion 253 is rotated.

When the fixing pin connecting portion 253 is rotated, because the fixing pin 242 combined with the fixing pin connecting portion 253 moves in the vertical direction of the fixing plate 250 and the casing 110, it is separated from the insertion hole 241 of the rotation restraint plate 240, and accordingly it releases the rotation restraint plate 240.

In this state, when the driving force is generated in the power transmitting unit (S1), the driving force is transmitted to the rotational gear 140, the rotational gear 140 rotates, and simultaneously the driving shaft 130 combined with the rotational gear 140 is rotated.

When the driving shaft 130 is rotated, the rotational force of the driving shaft 130 is transmitted to the conveying rollers (R) through the gear train (G) and the sub shafts 50, the conveying rollers (R) are rotated, by the rotation of the conveying rollers (R), and the media (B), loaded in the casing 110, are conveyed to the media conveying unit.

In the meantime, when the media cassette 100 is separated from the media dispensing machine, the first control key 231 and the second control key 232 of the control key 230 are respectively separated from the first releasing portion 254 of the fixing pin connecting portion 253 and from the second releasing portion 256 of the sliding member 259 by the elastic force of the first elastic member 255. The fixing pin connecting portion 253 is returned to its initial position, and simultaneously, the fixing pin 242 is horizontally moved and is inserted into the insertion hole 241 of the rotation restraint plate 240, and accordingly the rotation of the rotation restraint plate 240 and the driving shaft 130 connected to the rotation restraint plate 240 is restrained.

Simultaneously, by the elastic force of the second elastic member 257, the sliding member 259 is moved toward the fixing pin connecting portion 253 and returns to its initial position, the sliding member 259 restrains the fixing pin connecting portion 253.

The operation of the media cassette further including the state display unit will now be described in detail.

First, in order to load media in the media cassette, when an administrator opens the door 120, the door 120 is rotated centering around the hinge shaft and is opened. With the rotation of the door 120, the rotation power is transmitted to the second link portion 330 through the door link portion, the second link portion 330 slides upwardly, and accordingly the engaging portion 331 engages with the link pin 321 of the first link portion 330.

Herein, in the first link portion 320, by the elastic force of the third elastic member 315, the link pin 321 projects outwardly from the internal wall 110*a* of the casing 110, and the second link portion 330 is affected by the pushing force of the fourth elastic member 333 and is fixed by engaging with the link pin 321.

The second link portion 330 is moved upwardly and the green portion 332*b* of the display surface 332 of the second link portion 330 is placed in the display hole 340 of the casing 110.

After loading the media inside the media cassette, the combining pin 351*d* of the first door link member 351 moves along the long holes 352*a*, 353*b* of the second door link member 352 while closing the door 120. The door 120 is closed without transmitting power to the second link portion 330. The green portion 332*b* is displayed in the display hole 340 of the casing 110 of the media cassette as it is.

As described above, the media cassette loaded with the media is moved and is mounted in the media dispensing machine.

In the meantime, when a robber removes the media by using the media dispense security unit 200, the first releasing portion 254 of the media dispense security unit 200 pushes the first link portion 320, and the first link portion 320 is guided by the first supporting member 310 and slides in the horizontal direction. Herein, the first releasing portion 254 is designed not to contact with the first link portion 320 when the control key 230 is inserted.

When the first link portion 320 is moved horizontally, because the link pin 321 of the first link portion 320 is horizontally moved, the restraint of the engaging portion 331 is released, and the second link portion 330 slides downwardly due to the elastic force of the fourth elastic member 333.

According to the downward movement of the second link portion 330, the red portion 332*b* of the display surface 332 is moved downwardly, and the red portion 332*b* of the display surface 332 is placed in the display hole 340.

Due to this, when the media loaded in the media cassette is forcibly removed, the red portion 332*b* is displayed in the display hole 340 of the media cassette, and accordingly the administrator can easily check if the media are forcibly removed.

As described above, in the media cassette in accordance with the present invention, by preventing media loaded in the media cassette from being forcibly removed, it is possible to prevent the media loaded in the media cassette from being robbed, and accordingly the security and reliability of the media cassette can be improved.

In addition, in the media cassette in accordance with the present invention, if media loaded in the media cassette are forcibly removed, because the media cassette shows a certain indication, it is possible to check the accident instantly, and accordingly problems after the robbery can be solved quickly as well as provide protection against robbery.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A media cassette of a media dispensing machine, comprising:

a casing disposed in a media cassette receiving unit of a media dispensing machine;

a media loading unit disposed in the casing and storing media;

a driving unit installed at a certain side of the media loading unit inside the casing and operated by a power transmitting unit of the media dispensing machine for dispensing the media stored in the media loading unit;

a media guiding unit installed so as to connect the driving unit with an outlet formed at the outer surface of the casing for guiding the media dispensed by the driving unit to a media conveying unit of the media dispensing machine; and a media dispense security unit for controlling the driving unit so as to operate only when the casing is installed in the media cassette receiving unit of the media dispensing machine, said media dispense security unit including an operation restraint unit for restraining the operation of the driving unit in order to prevent the rotation of a driving shaft of the driving unit; and a control key coupling unit for releasing the operation restraint unit in order to operate the driving unit when a control key installed to the media cassette receiving unit is inserted.

2. The media cassette of claim 1, wherein the operation restraint unit includes:

a rotation restraint plate inserted into the driving shaft of the driving unit and containing a plurality of insertion holes making a circle centering around the driving shaft; and a fixing pin combined with the control key coupling unit and inserted/separated into/from the insertion hole by the operation of the control key coupling unit.

3. The media cassette of claim 1, wherein the control key coupling unit includes:

a fixing plate vertical to the driving shaft of the driving unit and installed at the internal wall of the casing;

a fixing pin connecting portion connected to the fixing plate and having a slot in which a sub pin fixed to the fixing pin is inserted;

a first releasing portion for releasing the fixing pin from the insertion hole by linearly moving the fixing pin by moving the fixing pin connecting portion with the control key;

a first elastic member for returning the fixing pin connecting portion to an initial position;

a second releasing portion for fixing the fixing pin connecting portion and releasing it by the operation of the control key; and a second elastic member for returning the second releasing portion to an initial position.

4. The media cassette of claim 3, wherein the fixing pin connecting portion rotatively combines with a supporting portion formed at the fixing plate, and the fixing pin is linearly moved while the first releasing portion is moved by the control key.

5. The media cassette of claim 4, wherein the fixing pin connecting portion includes a protrusion portion, and the second releasing portion fixes the fixing pin connecting portion by fixing the protrusion portion so as not to rotate.

6. The media cassette of claim 5, wherein the second releasing portion includes:

a sliding member contacted to the protrusion portion; and a supporting member for fixing the sliding member to the fixing plate so as to be linearly moved.

7. The media cassette of claim 3, wherein the first releasing portion releases the fixing pin from the insertion hole by linearly moving the fixing pin connecting portion toward the opposite direction of the rotation restraint plate by the control key.

8. The media cassette of claim 1, further comprising:

a state display unit for informing the operation of the media dispense security unit when the media cassette is not mounted in the media cassette receiving unit and the media dispense security unit is operated.

9. The media cassette of claim 8, wherein the state display unit includes:

a first supporting member fixedly installed at the internal surface of the casing;

a first link portion disposed in the casing, supported by the first supporting member in contacting with the first releasing portion, performing a linear motion by the first releasing portion and having a link pin at the end;

a second link portion installed at a second supporting member fixedly installed at the outside of the internal wall of the casing so as to perform the linear motion vertically in the motion direction of the first link portion, having an engaging portion engaged with the link pin and a pair of display surfaces;

a third elastic member for returning the second link portion to the initial position;

a display hole formed at the casing to show only one of the display surfaces to the outside according to the moving of the second link portion; and a display key insertion hole formed at the casing to receive a display key formed at the media cassette receiving unit in order to fix the second link portion when the media cassette is mounted in the media cassette receiving unit, wherein the link pin releases the engaging portion by moving linearly by the first releasing portion when the media cassette is not mounted in the media cassette receiving unit, the second link portion moves linearly, and the display surface shows the operation of the media dispense security unit through the display hole.

10. The media cassette of claim 9, wherein the state display unit is link-combined with a door link portion so as to engage the engaging portion with the link pin when the door for covering the media loading unit is opened.

11. The media cassette of claim 10, wherein the door link portion includes:

a first door link member connected-combined with a door combining pin installed at the internal surface of the door and having a slot in which a side combining pin formed at the side surface of the casing on which the state display unit is installed is inserted; and a second door link member having a first slot in which a combining pin of the first door link member is inserted at the end and having a second slot in which a link combining pin of the second link portion is inserted at the other end.

12. A media cassette of a media dispensing machine comprising:

a media cassette receiving unit;

a casing disposed in a media cassette receiving unit of a media dispensing machine;

a media loading unit disposed in the casing and storing media;

a driving unit installed at a certain side of the media loading unit inside the casing and operated by a power transmitting unit of the media dispensing machine for dispensing the media stored in the media loading unit;

a media guiding unit installed so as to connect the driving unit with an outlet formed at the outer surface of the casing and guiding the media dispensed by the driving unit to a media conveying unit of the media dispensing machine;

a media dispense security unit for controlling the driving unit so as to operate only when the casing is installed in the media cassette receiving unit of the media dispensing machine; and a state display unit for informing the operation of the media dispense security unit when the media cassette is not mounted in the media cassette receiving unit and the media dispense security unit is operated.

13. A media cassette of a media dispensing machine comprising:

a casing disposed in a media cassette receiving unit of a media dispensing machine;

a media loading unit disposed in the casing and storing media;

a driving unit installed at a certain side of the media loading unit inside the casing, operated by a power transmitting unit of the media dispensing machine and dispensing the media stored in the media loading unit, a media guiding unit installed so as to connect the driving unit with an outlet formed at the outer surface of the casing and guiding the media dispensed by the driving unit to a media conveying unit of the media dispensing machine;

a control key including a first control key curved-extended from the end of the fixation portion having a certain area and length vertical to the surface of the fixation portion and having a slant at the end, and a second control key curved-extended from the other end of the fixation portion and having a slant at the end; and a media dispense security unit for controlling the driving unit so as to operate only when the casing is installed in the media cassette receiving unit of the media dispensing machine.

14. The media cassette of claim 13, wherein the media dispense security unit includes:

an operation restraint unit for restraining the operation of the driving unit in order not to rotate a driving axis of the driving unit; and a control key gear unit, for releasing the operation restraint unit in order to operate the driving unit when a control key installed to the media cassette receiving unit is inserted.

15. The media cassette of claim 14, wherein the control key gear unit includes:

a fixation plate vertical to the driving axis of the driving unit and installed at the internal wall of the casing;

a fixation pin connecting portion connected to the fixation plate and having a slot in which a sub pin fixed to the fixation pin is inserted;

a first releasing portion for releasing the fixation pin from the insertion hole by linearly moving the fixation pin by moving the fixation pin connecting portion with the first control key;

a first elastic member for returning the fixation pin connecting portion to an initial position;

a second releasing portion for fixing the fixation pin connecting portion and releasing it by the operation of the second control key; and a second elastic member for returning the second releasing portion to an initial position.

16. The media cassette of claim 15, wherein the fixation pin connecting portion rotatively combines with a supporting portion formed at the fixation plate, and the fixation pin is linearly moved while the first releasing portion is moved by the control key.

17. The media cassette of claim 16, wherein the fixation pin connecting portion includes a protrusion portion, and the second releasing portion fixes the fixation pin connecting portion by fixing the protrusion portion so as not to rotate.

18. The media cassette of claim 17, wherein the second releasing portion includes:

a sliding member contacted to the protrusion portion; and a supporting member for fixing the sliding member to the fixation plate so as to be linearly moved.

* * * * *